US008794110B2

(12) United States Patent
Kriz et al.

(10) Patent No.: US 8,794,110 B2
(45) **Date of Patent: *Aug. 5, 2014**

(54) ROTARY RATCHET WRENCH

(75) Inventors: Anthony Kriz, Lone Tree, CO (US); Brent Christopher, Portland, OR (US); Mark Holtan, Centennial, CO (US)

(73) Assignee: Meridian International Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/269,983

(22) Filed: Oct. 10, 2011

(65) Prior Publication Data

US 2012/0024115 A1 Feb. 2, 2012

Related U.S. Application Data

(63) Continuation of application No. 12/617,200, filed on Nov. 12, 2009, now Pat. No. 8,069,753.

(51) Int. Cl.

| | |
|---|---|
| ***B25B 13/46*** | (2006.01) |
| ***B25B 13/06*** | (2006.01) |
| ***B25B 23/00*** | (2006.01) |
| ***B25B 13/56*** | (2006.01) |

(52) U.S. Cl.

CPC ..... *B25B 13/461* (2013.01); *B25B 13/463* (2013.01); *B25B 23/0028* (2013.01); *B25B 13/56* (2013.01); *B25B 13/06* (2013.01)

USPC ..... 81/60; 81/124.5

(58) Field of Classification Search

USPC ..... 81/60, 124.3, 61, 125.1, 124.4, 124.5, 81/177.7, 177.8, 177.9, 59.1

See application file for complete search history.

(56) References Cited

U.S. PATENT DOCUMENTS

| | | | | | |
|---|---|---|---|---|---|
| 65,550 | A | * | 6/1867 | Dunlap | 81/124.5 |
| 103,656 | A | | 5/1870 | Mathias | |
| 278,053 | A | | 5/1883 | Shipherd | |
| 915,446 | A | | 3/1909 | Kearnes | |
| D53,597 | S | * | 7/1919 | Marcmann | 81/124.4 |
| 1,320,137 | A | | 10/1919 | Gunn | |
| 1,331,956 | A | | 2/1920 | Cross | |
| D57,323 | S | | 3/1921 | Evans | |

(Continued)

FOREIGN PATENT DOCUMENTS

| | | |
|---|---|---|
| DE | 1136950 | 9/1962 |
| DE | 2231385 | 1/1974 |

(Continued)

OTHER PUBLICATIONS

European Search Report dated Feb. 17, 2011 from related foreign application.

(Continued)

*Primary Examiner* — Hadi Shakeri

(74) *Attorney, Agent, or Firm* — Jason R. Sytsma; Shuttleworth & Ingersoll, PLC

(57) ABSTRACT

A hand tool is disclosed. The hand tool has a gripping portion and a distal end with an attachment end disposed thereon. A ratcheting mechanism is combined with the attachment end to provide ratcheting action. A rotatable head is combined with the attachment end and engaged with the ratcheting mechanism. The rotatable head comprises a plurality of sockets and in some embodiments the rotatable head has four sockets of different size spaced thereon.

5 Claims, 3 Drawing Sheets

(56) References Cited

U.S. PATENT DOCUMENTS

| | | | | |
|---|---|---|---|---|
| 1,412,688 | A * | 4/1922 | Layton et al. | 81/59.1 |
| 1,426,127 | A * | 8/1922 | Tuttle | 81/60 |
| 1,431,064 | A | 10/1922 | Treisch | |
| 1,453,607 | A | 5/1923 | Saucier | |
| 1,519,800 | A | 12/1924 | Rifflard | |
| 1,571,148 | A * | 1/1926 | Sisolak | 81/124.5 |
| 1,601,767 | A | 10/1926 | Peterson | |
| 1,723,033 | A | 8/1929 | Hartley | |
| 1,796,083 | A | 3/1931 | Carlberg | |
| 1,811,137 | A | 6/1931 | Kress | |
| 2,028,561 | A | 1/1936 | Pilger | |
| 2,491,623 | A | 12/1949 | Sesak | |
| 2,500,835 | A | 3/1950 | Lang | |
| 2,628,522 | A | 2/1953 | Kraft | |
| 2,712,258 | A | 7/1955 | Keith | |
| 2,751,802 | A | 6/1956 | Reuillard | |
| 2,769,360 | A | 11/1956 | Cottrell | |
| 2,951,405 | A | 9/1960 | Engquist | |
| 3,044,591 | A | 7/1962 | Kilness | |
| 3,342,229 | A | 9/1967 | Igor | |
| 3,475,999 | A | 11/1969 | Roberts et al. | |
| D224,677 | S | 8/1972 | Lehnhard | |
| 4,257,507 | A | 3/1981 | Solomon | |
| 4,515,044 | A * | 5/1985 | Harstad | 81/61 |
| 4,722,252 | A * | 2/1988 | Fulcher et al. | 81/63 |
| 4,748,875 | A | 6/1988 | Lang | |
| D299,206 | S | 1/1989 | Krapowicz | |
| 4,901,608 | A | 2/1990 | Shieh | |
| 4,916,987 | A | 4/1990 | Le Duc | |
| 5,119,701 | A | 6/1992 | Wei | |
| D332,730 | S | 1/1993 | Usuda | |
| 5,199,335 | A | 4/1993 | Arnold et al. | |
| 5,325,744 | A * | 7/1994 | Horikawa | 81/124.5 |
| 5,568,751 | A | 10/1996 | Lee | |
| 5,636,557 | A | 6/1997 | Ma | |
| 5,848,561 | A * | 12/1998 | Hsieh | 81/59.1 |
| 6,000,302 | A | 12/1999 | Chiang | |
| 6,050,165 | A | 4/2000 | Hall | |
| 6,101,902 | A * | 8/2000 | Wei | 81/63 |
| 6,125,725 | A | 10/2000 | Fox et al. | |
| 6,134,990 | A | 10/2000 | Ling et al. | |
| 6,253,646 | B1 * | 7/2001 | Chang | 81/59.1 |
| 6,263,768 | B1 | 7/2001 | Huang et al. | |
| 6,282,992 | B1 | 9/2001 | Hu | |
| 6,295,898 | B1 | 10/2001 | Hsieh | |
| 6,405,621 | B1 | 6/2002 | Krivec et al. | |
| 6,409,015 | B1 | 6/2002 | Hu | |
| 6,453,779 | B2 | 9/2002 | Hu | |
| 6,626,067 | B1 | 9/2003 | Iwinski et al. | |
| 6,629,477 | B2 | 10/2003 | Ling et al. | |
| 6,722,234 | B2 | 4/2004 | Hu | |
| D492,556 | S | 7/2004 | Barry et al. | |
| 6,769,330 | B2 | 8/2004 | Chang | |
| 6,782,777 | B1 | 8/2004 | Wei | |
| 6,820,742 | B1 | 11/2004 | Chen | |
| 6,862,956 | B1 | 3/2005 | Chen | |
| 6,868,759 | B2 | 3/2005 | Tuan-Mu | |
| 6,883,404 | B2 | 4/2005 | Hsien | |
| D506,373 | S | 6/2005 | Hsien | |
| 6,918,323 | B2 | 7/2005 | Arnold et al. | |
| 6,971,286 | B2 | 12/2005 | Hu | |
| 7,004,052 | B1 | 2/2006 | Shu-Sui et al. | |
| 7,032,478 | B2 | 4/2006 | Hu | |
| 7,066,055 | B1 | 6/2006 | Lee | |
| 7,082,860 | B2 | 8/2006 | Shu-Sui et al. | |
| 7,168,345 | B1 * | 1/2007 | Hsieh | 81/177.7 |
| 7,185,566 | B2 | 3/2007 | Arnold et al. | |
| 7,231,851 | B2 | 6/2007 | Tuan-Mu | |
| 7,237,460 | B2 | 7/2007 | Hu | |
| D551,525 | S | 9/2007 | Desbrunes | |
| 7,264,213 | B2 | 9/2007 | Liu | |
| 7,267,033 | B1 | 9/2007 | Lai et al. | |
| 7,281,452 | B2 | 10/2007 | Chang | |
| 7,299,720 | B1 | 11/2007 | Schultz et al. | |
| 7,311,022 | B2 | 12/2007 | Putney et al. | |
| 7,318,366 | B2 | 1/2008 | Lee et al. | |
| 7,424,839 | B2 | 9/2008 | Chiang | |
| 7,444,902 | B1 | 11/2008 | Lin et al. | |
| 7,444,904 | B2 | 11/2008 | Huang | |
| 7,478,577 | B1 | 1/2009 | Wheeler | |
| 7,509,894 | B2 | 3/2009 | Chen | |
| 7,523,688 | B2 | 4/2009 | Putney et al. | |
| 7,565,973 | B2 | 7/2009 | Chang | |
| D601,871 | S | 10/2009 | Murray | |
| 7,827,886 | B2 | 11/2010 | Hu | |
| 7,966,912 | B1 | 6/2011 | Hobden et al. | |
| 8,141,460 | B2 | 3/2012 | Hobden et al. | |
| 8,312,794 | B2 | 11/2012 | Hobden et al. | |
| 2003/0015070 | A1 | 1/2003 | Chen | |
| 2004/0040422 | A1 | 3/2004 | Chuang | |
| 2004/0093994 | A1 | 5/2004 | Hsiao | |
| 2004/0129114 | A1 | 7/2004 | Chen | |
| 2005/0166718 | A1 | 8/2005 | Chang | |
| 2005/0178247 | A1 | 8/2005 | Arnold et al. | |
| 2007/0044600 | A1 | 3/2007 | Chen | |
| 2007/0107560 | A1 | 5/2007 | Chiang | |
| 2007/0256525 | A1 | 11/2007 | Lee | |
| 2007/0277652 | A1 | 12/2007 | Tuan-Mu | |
| 2009/0301265 | A1 | 12/2009 | Hu | |
| 2009/0314139 | A1 | 12/2009 | Hu | |
| 2010/0050818 | A1 | 3/2010 | Rogers | |
| 2010/0326246 | A1 | 12/2010 | Chang | |
| 2011/0017024 | A1 | 1/2011 | Kriz | |
| 2011/0197714 | A1 | 8/2011 | Meholovitch | |
| 2011/0197718 | A1 | 8/2011 | Meholovitch | |

FOREIGN PATENT DOCUMENTS

| | | |
|---|---|---|
| DE | 202004000843 | 4/2004 |
| DE | 202006019735 | 3/2007 |
| EP | 0079440 | 5/1983 |
| FR | 630775 | 12/1927 |

OTHER PUBLICATIONS

Sears, Craftsman DOG BONE SAE Wrench, webpage—Product Description http://www.sears.com/she/s/ProductDisplay . . . -*Date unknown but prior to U.S. filing date*, prior to Nov. 2008.

Snap-On, Wrenchy, Ratcheting Box, 25° Offset, Product Webpage http:/ /buy1.snapon.com/catalog/ . . . —*Date unknown but prior to U.S. filing date*, prior to Nov. 2008.

* cited by examiner

ROTARY RATCHET WRENCH

This application is a continuation of U.S. patent application Ser. No. 12/617,200 filed Nov. 12, 2009, which application is incorporated by reference herein.

BACKGROUND

The instant invention relates generally to wrenches and more specifically it relates to a ratcheting box wrench having multiple sockets.

Numerous wrenches have been provided in prior art that are hand held tools for gripping, turning or twisting objects such as nuts or bolts. While these units may be suitable for the particular purpose to which they address, they would not be as suitable for the purposes of the present invention as heretofore described.

SUMMARY

A hand tool is disclosed. The hand tool has a gripping portion and a distal end with an attachment end disposed thereon. A ratcheting mechanism is combined with the attachment end to provide ratcheting action. A rotatable head is combined with the attachment end and engaged with the ratcheting mechanism. The rotatable head comprises a plurality of sockets and in some embodiments the rotatable head has four sockets of different size spaced thereon.

As previously stated, the ratcheting mechanism is combined with the attachment end. An inner circumference with an annular groove extending therearound is formed in the attachment end. A chamber extends from the attachment end into the handle. A gear ring of the ratcheting mechanism is disposed in the annular groove and engaged with a ratchet tooth disposed in the chamber.

In one embodiment, the attachment end is a box end and has a substantially circular outline. The rotatable head is substantially ball shaped and has an imaginary line on the sockets surface extending therearound about which is disposed four sockets equidistance apart.

In yet another embodiment, a second attachment end is disposed at the other distal end of the handle. A ratcheting mechanism is provided in the attachment end. A rotatable head combined with the second attachment end engages the ratcheting mechanism.

FIGURES

For a more complete understanding of particular embodiments and their features and advantages, reference is now made to the following description, taken in conjunction with the accompanying drawings, in which.

DETAILED DESCRIPTION

Figure 1:
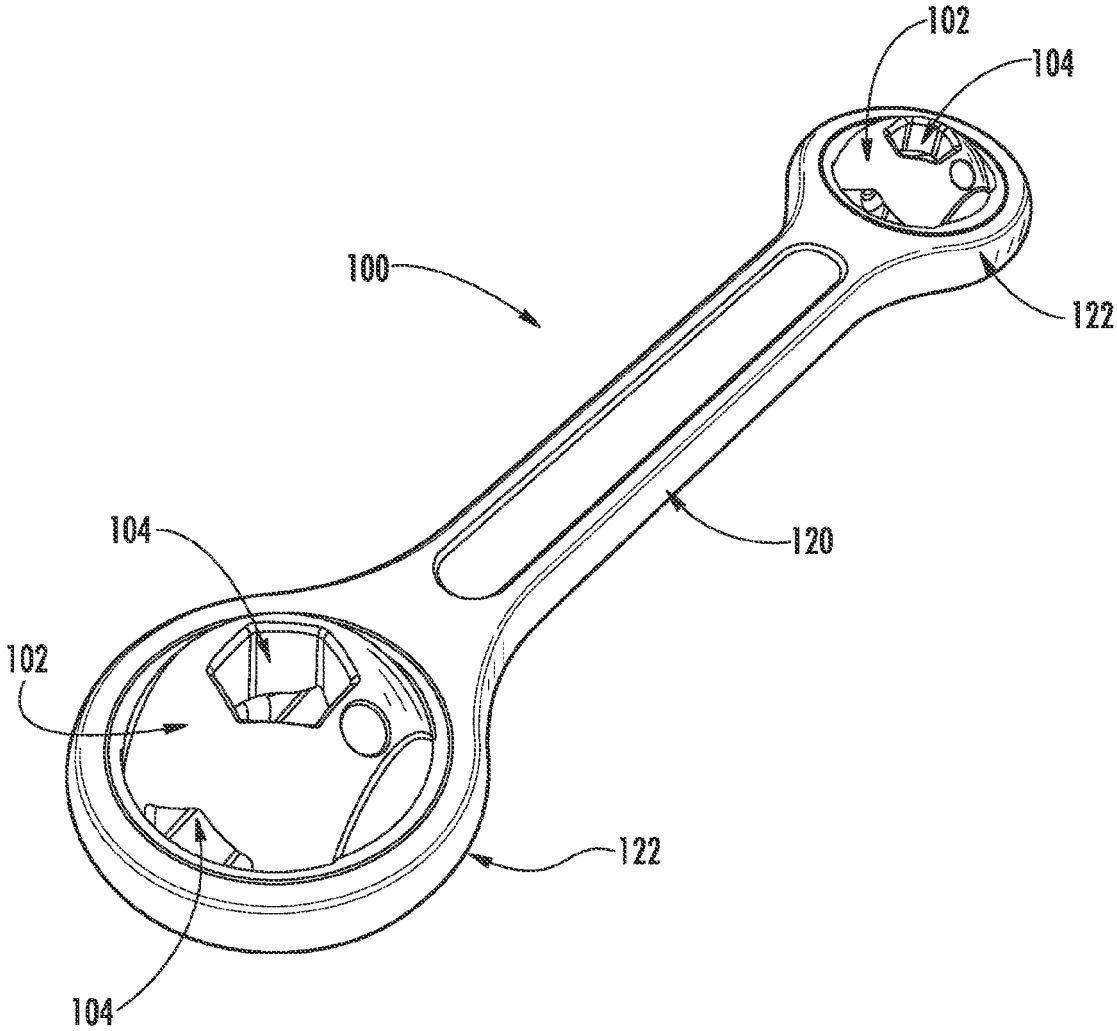
FIG. 1 is a perspective view of a preferred embodiment of the rotary ratchet wrench.
Figure 2:
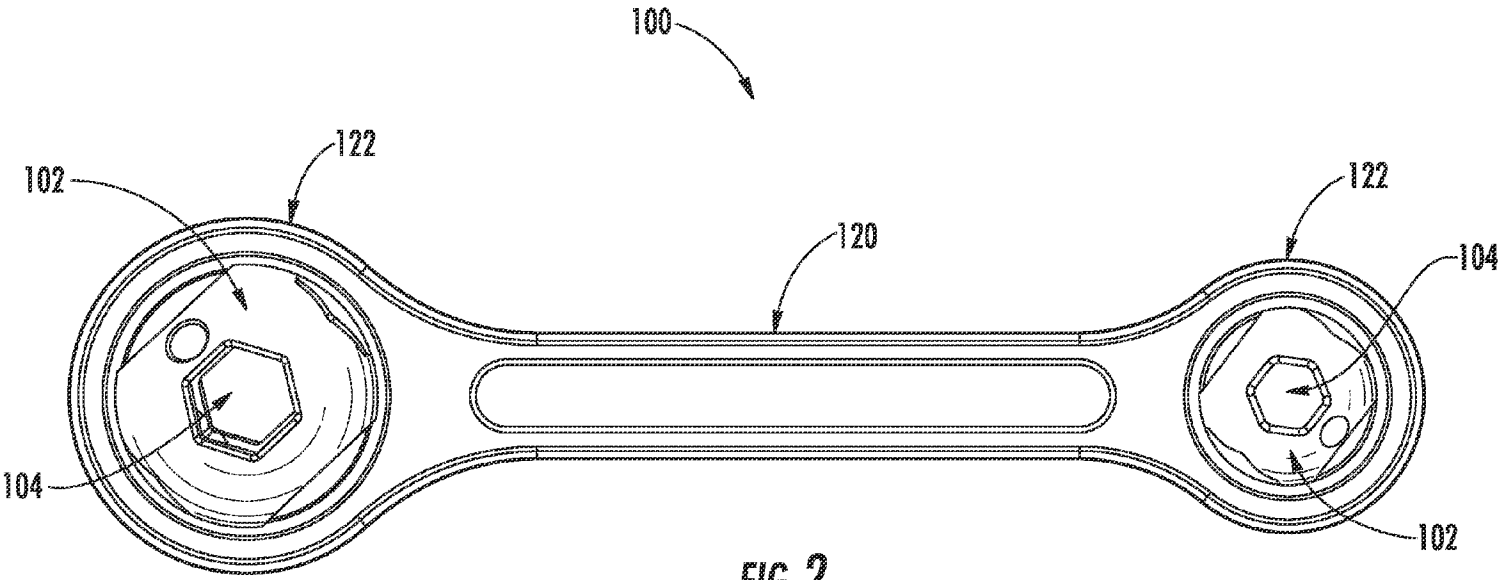
FIG. 2 is a top view of the preferred embodiment of the rotary ratchet wrench.
Figure 3:
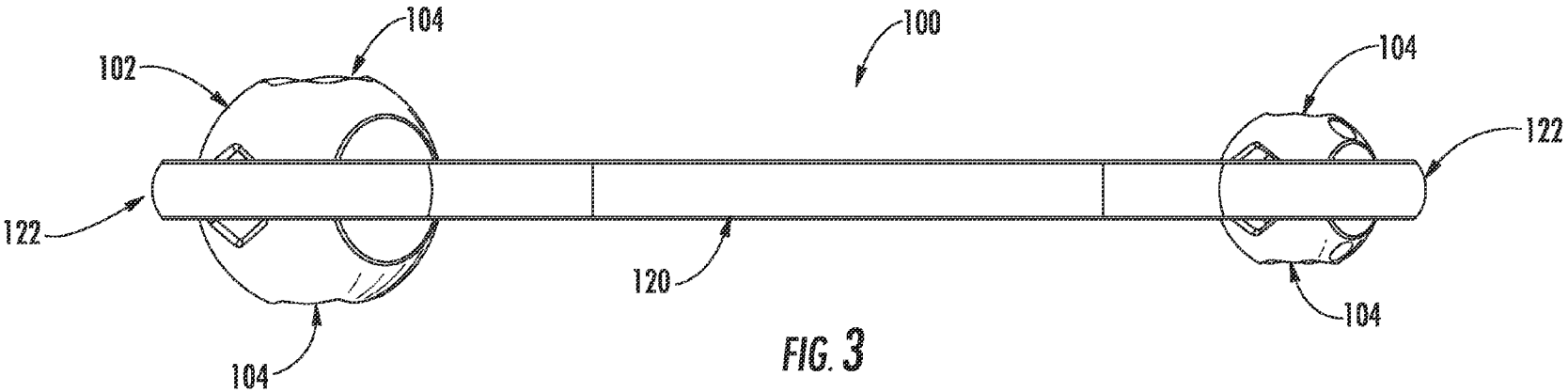
FIG. 3 is a side view of the preferred embodiment of the rotary ratchet wrench.

Referring to FIGS. 1-4, a preferred embodiment of a rotary ratchet wrench 100 is disclosed. The rotary ratchet wrench 100 contains an ergonomic handle 120 which terminates at opposed distal ends. An attachment end 122 is disposed at at least one of the distal ends of the handle 120. The attachment end 122 includes a ratcheting mechanism 200 (see FIG. 4) and a rotatable head 102 having a plurality of sockets 104. The rotatable head 102 advantageously provides an improvement over prior art box end wrenches by disposing a plurality sockets 104 on a single rotatable head 102. Further, the ratcheting mechanism 200 converts the multiple socket 104 rotary ratchet wrench 100 into a fast acting driving tool.

More specifically, the preferred embodiment discloses a substantially ball shaped rotatable head 102 having four sockets 104 equally spaced around the periphery of the ball shaped rotatable head 102. The sockets 104 are different standard and/or metric sizes to fit a wide variety of bolt heads or nuts. Although the preferred embodiment is a substantially ball shaped, other shapes may be employed without departing from the scope of this invention.

Figure 4:
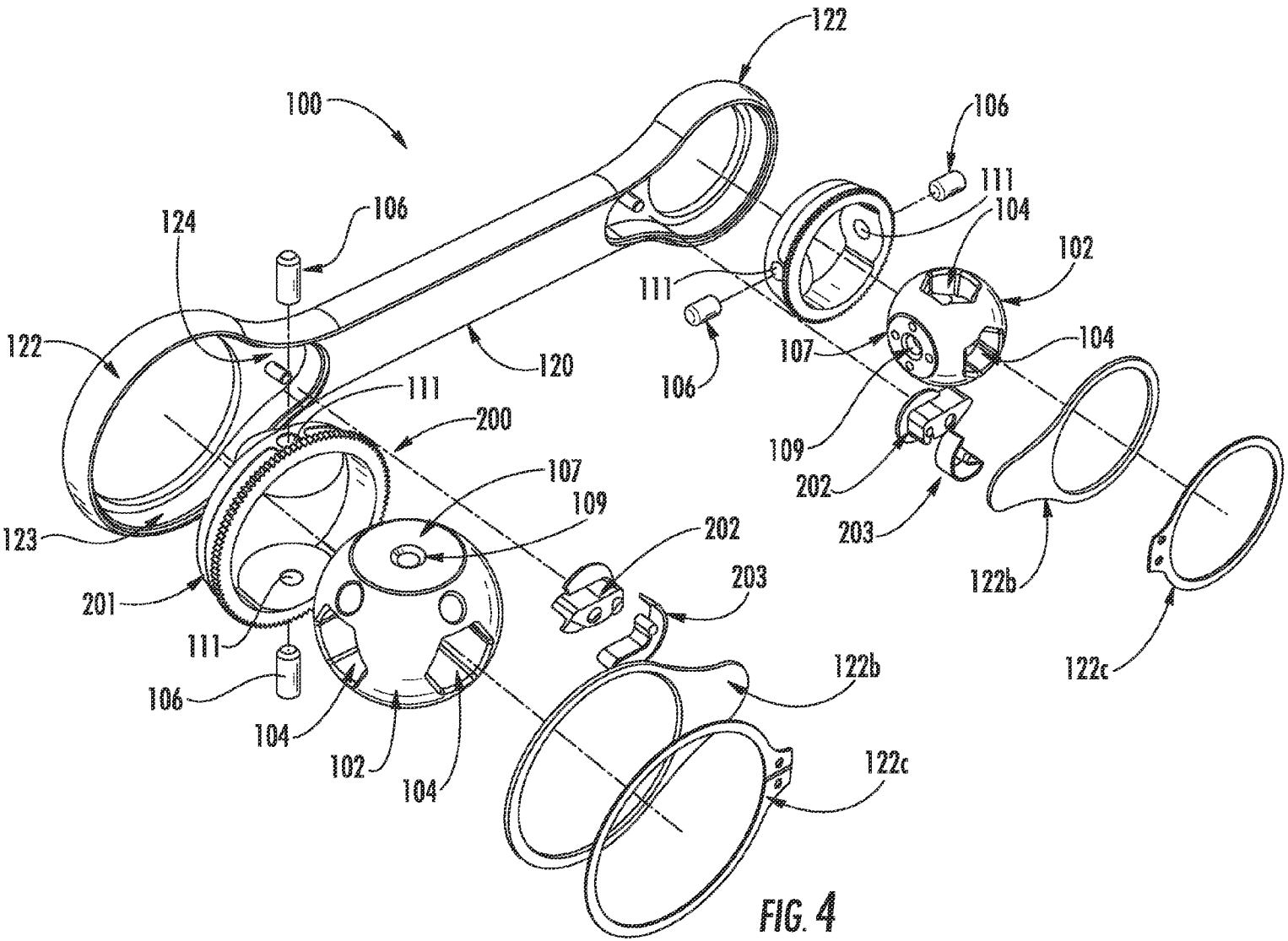
FIG. 4 is an exploded view of the preferred embodiment of the rotary ratchet wrench.

Illustrated in FIG. 4, the rotatable head 102 rotates on two pivot pins 106. The rotatable head 102 has two opposed flat faces 107 wherein a first receiving hole 109 is provided on the each of the respective faces 107. A pair of second receiving holes 111 is provided in the ratchet 200, and in the preferred embodiment, the second receiving holes 111 are formed on the inner circumference of a gear ring 201 (discussed more fully below). The pivot pins 106 are received in the holes 111 and holes 109 to combine the rotatable head 102 with the ratchet 200, thus the attachment end 122 allows the operator to rotate the rotatable head 102 between respective sockets 104.

As previously indicated, in the preferred embodiment, the rotary ratchet wrench 100 contains a ratcheting mechanism 200. The ratcheting mechanism 200 allows the user to reposition the rotary ratchet wrench 100 on the nut or bolt head for another stroke without having to completely remove the rotary ratchet wrench 100 from the nut or bolt head.

The ratcheting mechanism 200 includes, a gear ring 201 disposed in an annular groove 123 formed around an inner circumference of the attachment end 122 and a chamber 124 extending into the handle 120 wherein a ratchet tooth 202 is disposed. A cover **122*b* held in place by a snap-ring 122*c* covers the top of the attachment end 122 to cover the ratcheting mechanism 200 and complete the formation of the chamber 124. The ratcheting tooth 202 is biased by a spring 203 to engage the gear ring 201. Although a specific ratcheting mechanism 200 is disclosed as the preferred embodiment, any type of ratcheting mechanism 200** may be provided without departing from the scope of this invention.

In the preferred embodiment, the rotary ratchet 100 has a second attachment end 122 disposed at opposite end of the handle 120 at the second distal end, and having all the components and operating parts as previously described. However, one of the ends could contain any number of different tools without departing from the scope of the invention, for example a single size box end or open-ended wrench, a socket wrench, or a screw driver.

The invention herein disclosed advantageously combines a ratcheting mechanism 200 with multi-socket 104 box wrench 100. Although, ratcheting mechanisms 200 of some variety have been around for many years, never before has a ratcheting mechanism 200 been combined with a multiple socket 104 box wrench 100. In the preferred embodiment, two attachment ends 122 and two heads 102 contain a total of eight sockets 104 of different sizes. This advantageously consolidates eight hand tools into a single rotary ratchet wrench 100 with a ratcheting mechanism 200. In the decades that box end wrenches and ratcheting mechanisms have been around, no one has heretofore discovered a way to make the innovation herein disclosed.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A hand tool, comprising:

a handle with a gripping portion and a distal end;

an attachment end disposed at the distal end;

a ratcheting mechanism having a ring and a ratcheting tooth combined with the attachment end, the ring turnable with respect to the attachment end around a first axis, the ring includes a first pair of aligned receiving holes that extend into the ring and concealed by an outer perimeter of the attachment end without touching the ratcheting mechanism;

a retaining ring for fixing the ring in an axial position;

a rotatable head combined with the ring and rotatable with respect to the ring around a second axis that is perpendicular to the first axis, the rotatable head includes a second pair of receiving holes that extend into the rotatable head, such that when the rotatable head is combined with the ring the first and second pair of receiving holes are aligned; and a pair of pivot pins defining the second axis are positioned in the first and the second receiving holes to combine the rotatable head to the ring so that the rotatable head is operable with the ratcheting mechanism, wherein the rotatable head comprises at least three sockets spaced around a circumference of the rotatable head.

2. The hand tool of claim 1, wherein the rotatable head further comprises four sockets of different sizes.

3. The hand tool of claim 2, wherein the attachment end further comprises an inner circumference having an annular groove extending therearound, and a chamber extending into the handle.

4. The hand tool of claim 3, wherein the ring is a gear ring and is disposed in the annular groove and a biased ratcheting tooth is disposed in the chamber and engages the gear ring.

5. The hand tool of claim 1, and further comprising: a second attachment end disposed at an end opposite from the distal end and having a second ratcheting mechanism with a second rotatable head combined with the second ratcheting mechanism, wherein the handle is integral with the attachment end and the second attachment end forming a non-pivoting connection between the attachment end and the second attachment end and an integral fixed perimeter for the hand tool.

* * * * *